US008198876B2

(12) United States Patent
Gray et al.

(10) Patent No.: US 8,198,876 B2
(45) Date of Patent: Jun. 12, 2012

(54) POWER FACTOR COMPENSATING METHOD COMPENSATING POWER FACTORS OF ELECTRONIC DEVICES CONNECTED TO A COMMON POWER SOURCE

(75) Inventors: Richard Landry Gray, Saratoga, CA (US); Po Ming Tsai, Taipei (TW)

(73) Assignee: Richard Landry Gray, Saratoga, CA (US)

( * ) Notice: Subject to any disclaimer, the term of this patent is extended or adjusted under 35 U.S.C. 154(b) by 0 days.

(21) Appl. No.: 13/042,580

(22) Filed: Mar. 8, 2011

(65) Prior Publication Data

US 2011/0221401 A1 Sep. 15, 2011

Related U.S. Application Data

(60) Provisional application No. 61/311,781, filed on Mar. 9, 2010.

(51) Int. Cl.
*G05F 1/563* (2006.01)
*G05F 1/565* (2006.01)
*G05F 1/614* (2006.01)

(52) U.S. Cl. ..... 323/271; 323/272; 323/266; 323/282; 323/323

(58) Field of Classification Search ..... 323/244, 323/246, 266, 269, 271, 272, 276, 281, 282, 323/286, 319, 320, 323, 351, 365
See application file for complete search history.

(56) References Cited

U.S. PATENT DOCUMENTS

| | | | | |
|---|---|---|---|---|
| 5,227,712 | A * | 7/1993 | Boman | 320/141 |
| 5,905,369 | A * | 5/1999 | Ishii et al. | 323/272 |
| 6,172,492 | B1 * | 1/2001 | Pletcher et al. | 323/284 |
| 6,194,885 | B1 * | 2/2001 | Oshima | 323/285 |
| 2004/0217746 | A1 * | 11/2004 | Thiery et al. | 323/282 |

* cited by examiner

*Primary Examiner* — Matthew Nguyen
*Assistant Examiner* — Nusrat Quddus

(57) ABSTRACT

An approach is provided for a power factor compensating method to compensate other electronic devices that use a common power source in order to improve power factor from the perspective of a power company. The other electronic device is a type of a non-linear load, and the method enables a compensator to receive a supply voltage from the power source commonly connected to the traditional electronic devices and disables a load of the compensator for a period. The period corresponds to a range that makes an overall supply current more proportional to the supply voltage.

10 Claims, 9 Drawing Sheets

POWER FACTOR COMPENSATING METHOD COMPENSATING POWER FACTORS OF ELECTRONIC DEVICES CONNECTED TO A COMMON POWER SOURCE

This application claims priority benefit under 35 USC 119 of provisional patent application Ser. No. 61/311,781, filed 9 Mar. 2010.

Embodiments relate to a power factor compensating method, especially to a method that compensates other poor power factor electronic devices in a local power network (home, office, building, factory, thus improving power factor from the perspective of the whole grid of a power company.

BACKGROUND

Power Factor (PF) is a measure of how well an electric or electronic load resembles an ideal resistor. A power factor of "1.0" means that the load looks, from the power supplier's perspective, like a resistor. The power supply current of a load with PF=1 would be precisely proportional to the power supply voltage. In practice all electrical loads have a reactive component, inductive or capacitive, that cause the power factor to be less than 1.0. These reactive components cause the power supply current to lead or lag the power supply voltage. In addition to reactive components in many electrical loads, many also have some non-linear components that add harmonic content to the power supply current.

Power transfer from the power company to electrical load is most efficient if the power factor of the load is "1.0". However, in reality, all real loads have PF less than one. In the case of reactive loads the reactive current is not completely dissipated in the load. but it does cause increased power dissipation in the cables used to carry the current from the power company to the load. The problem is so severe that power companies need to add large reactive loads (usually capacitive components) to their transmission system in order to compensate for loads (usually inductive) with poor power factor. The other problem of low power factor loads from the perspective of a power company is that if the PF drops from 1.0 to 0.5 then the power company must double its generating capacity because generators are sized by their VA rating and not by their wattage rating. A high power factor grid means that fewer power plants need to be built.

With reference to FIGS. 1A and 1B, many electronic devices 1 include a full bridge rectifier 10 as part of their power supply module. The full bridge rectifier 10 is responsible for rectifying the Alternating Current (AC) voltage from AC power source 11 to the pulsating Direct Current (DC) voltage that is then further modified before eventually supplying load 12. These bridge rectifier loads (also known as non-linear loads 12) produce power supply current waveforms that are not proportional to the power supply voltage. The power supply current, as shown in FIG. 1B, looks more like a series of spikes 14. The spikes 14 are not exactly symmetrical with the power supply voltage waveform 13 because the voltage drop on the holding capacitor C is different at the leading and trailing edges of the current waveform 15.

With reference to FIG. 1C, a known circuit illustrated by the circuit in FIG. 1A is further connected with an active power factor correction circuit 16 for increasing power factor. The circuit, as shown in FIG. 1C, comprises a power factor correction circuit 16 having a power factor correction controller 161, a switch TR, a inductance L and a diode D. The power factor correction circuit 16 measures the pulsating DC voltage as well as the current and adjusts the switching time and duty cycle to present an in phase voltage and current.

There are many examples in the literature where active power factor correction circuitry can be added to electronic circuits for improving power factor. Such power factor correction circuitry works well, but it can only improve the power factor of newly installed electronic devices; it cannot improve the power factor of electronic devices with poor power factor that have been already installed.

Some Exemplary Embodiments

These and other needs are addressed by the exemplary embodiments, in which one approach provides for compensating electronic devices with better power factor.

Another approach is provided for improving power factor of a traditional electronic device that has already been installed.

According to one embodiment, a power factor compensating method compensates a power factor of a traditional electronic device connected to a power source, and the electronic device is a type of a non-linear load. The power factor compensating method enables a compensator to receive a supply voltage from the power source commonly connected to the traditional electronic device and disables a load in the compensator for a certain period relative to the supply voltage. The period corresponds to a range that makes an overall supply current more proportional to the supply voltage.

In one embodiment, the disabling period corresponds to a range that covers a peak of the supply voltage waveform.

Compared to the power factor of the traditional electronic device connected to the power source, the power factor compensating method with the exemplary embodiments provides compensation on areas of the supply current waveform where the current of the electronic device is not proportional to the supply voltage from the power source. This improves the power factor of the traditional electronic device from the perspective of a power company.

Still other aspects, features and advantages of the exemplary embodiments are readily apparent from the following detailed description, by illustrating a number of particular embodiments and implementations, including the best mode contemplated for carrying out the exemplary embodiments. The exemplary embodiments are also capable of other and different embodiments, and their several details can be modified in various obvious respects, all without departing from the spirit and scope of the exemplary embodiments. Accordingly, the drawings and description are to be regarded as illustrative, and not as restrictive.

BRIEF DESCRIPTION OF THE DRAWINGS

The exemplary embodiments are illustrated as examples, and not as a way of limitation, in the figures of the accompanying drawings in which like reference numerals refer to similar elements and in which.

DESCRIPTION OF THE PREFERRED EMBODIMENT

Figure 1A:
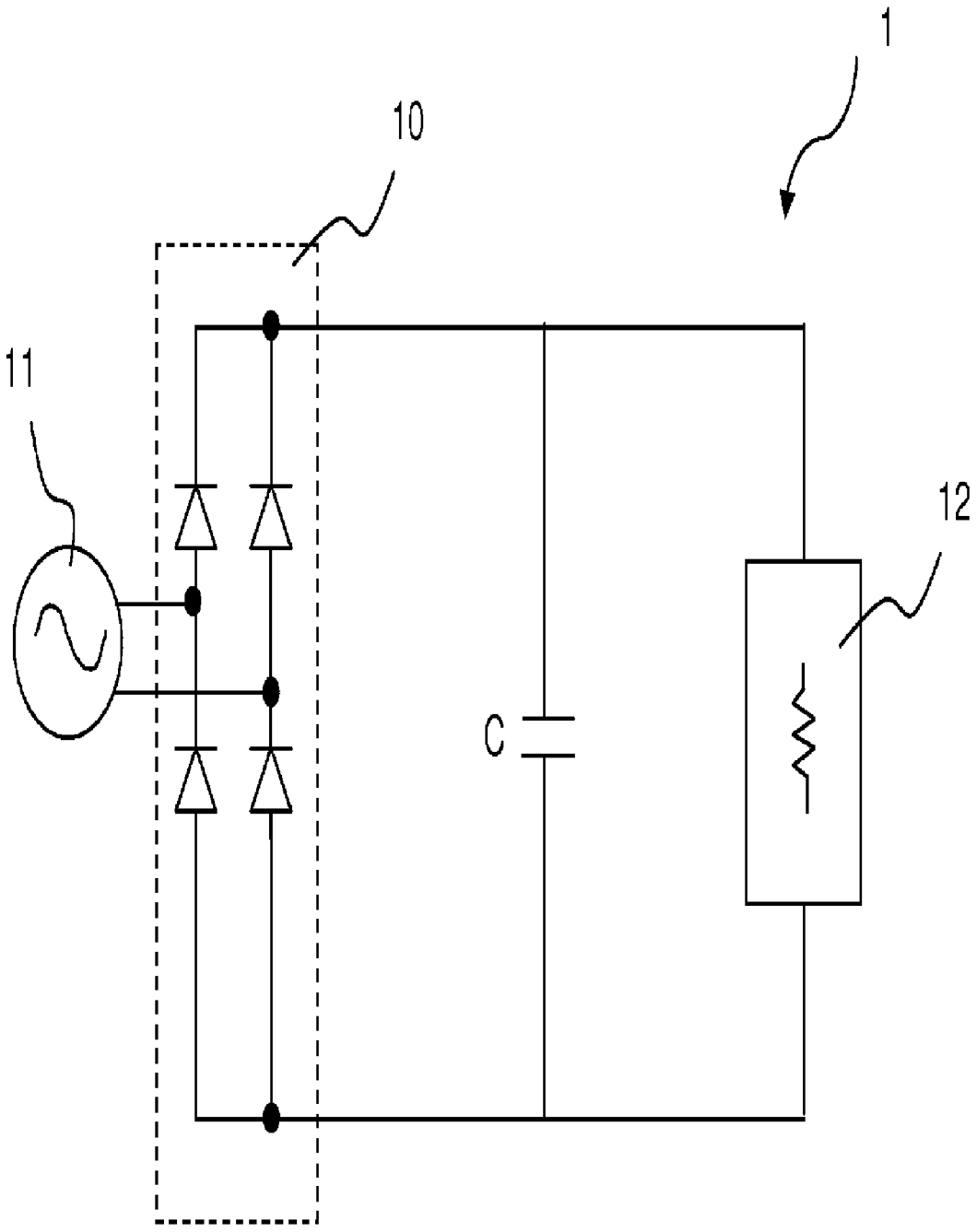
FIG. 1A is a circuit diagram of a conventional electronic device that includes a full bridge rectifier.
Figure 1B:
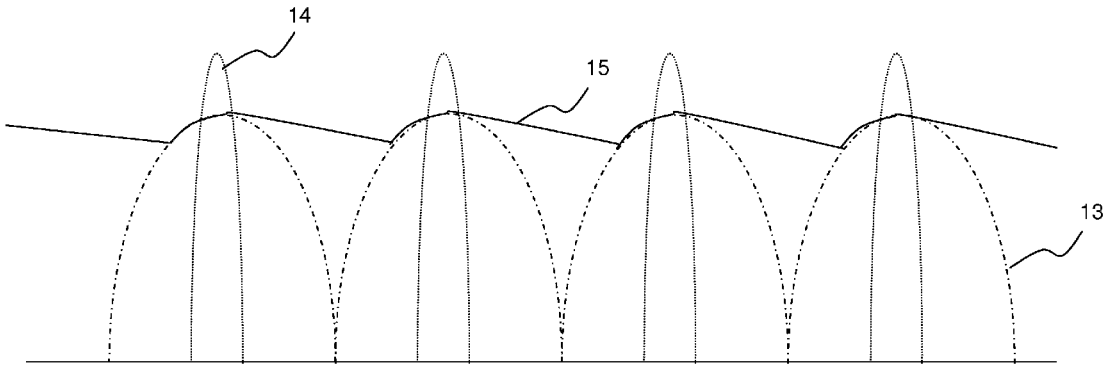
FIG. 1B is a waveform diagram of supply current and supply voltage of the electronic device in FIG. 1A.
Figure 1C:
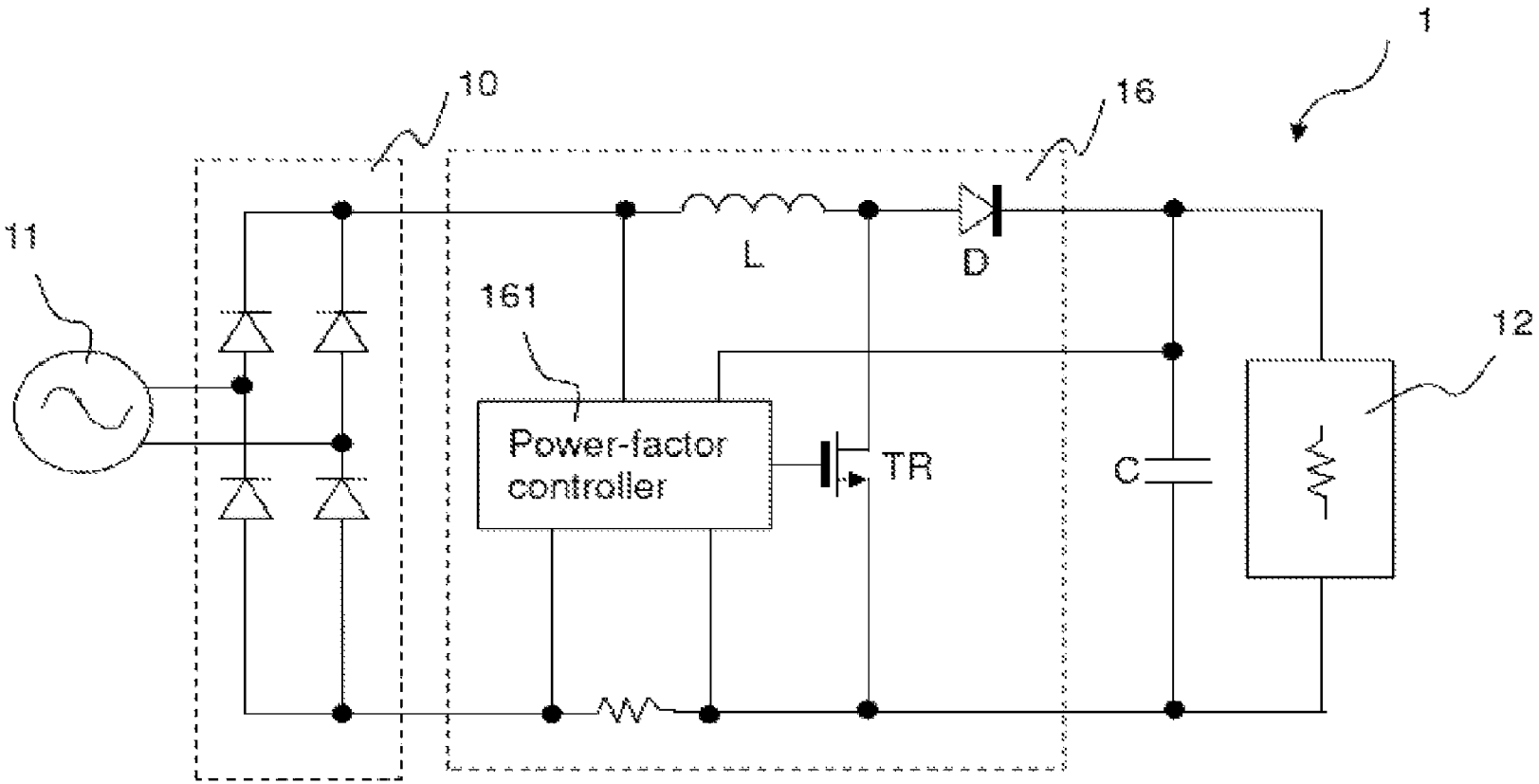
FIG. 1C is a circuit diagram of a conventional electronic device in FIG. 1A connected to a power factor correction circuit.
Figure 2:
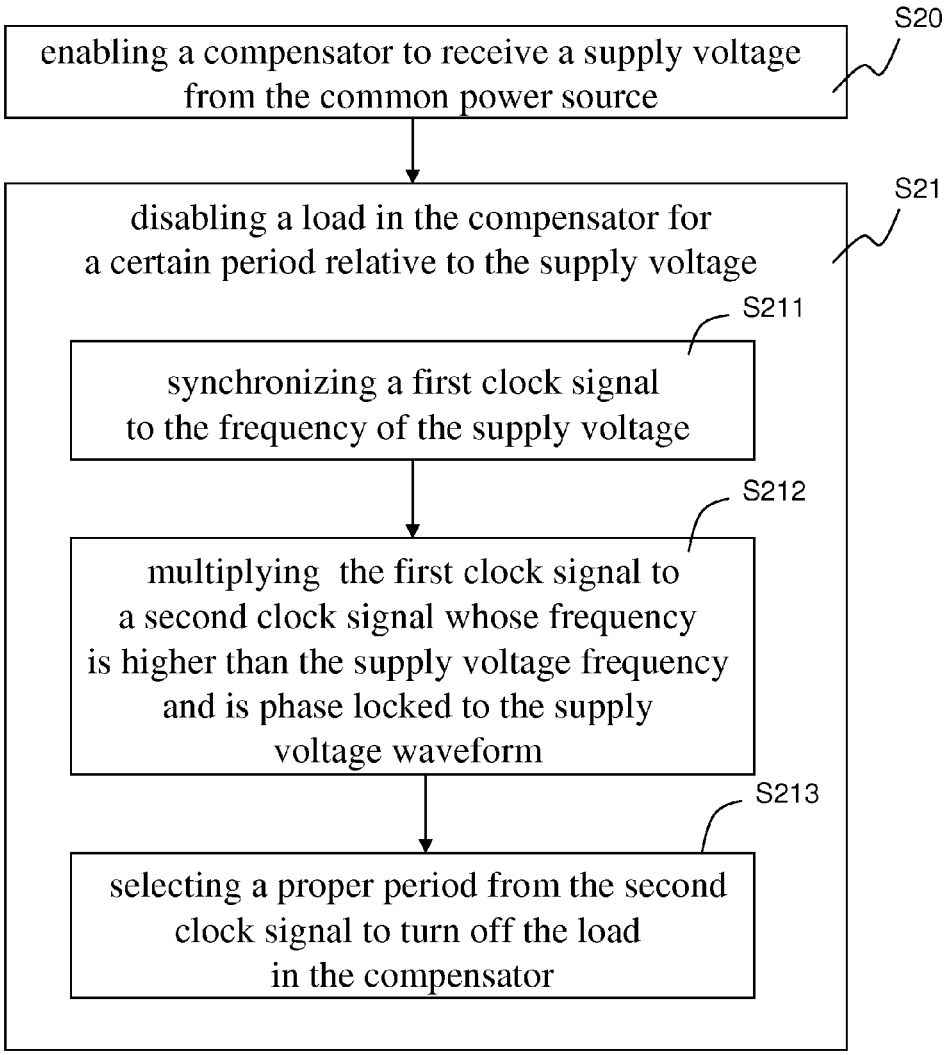
FIG. 2 is a flow diagram for a power factor compensating method according to an embodiment.

With reference to FIG. 2, FIG. 2 is a flow diagram for a power factor compensating method according to an embodiment. The power factor compensating method compensates the power factor of a traditional electronic device connected to a power source in common with a compensator's power source. The traditional electronic device is a type of a non-linear load. The power factor compensating method comprises acts of S20 enabling the compensator to receive a supply voltage from the power source and S21 disabling a load in the compensator for a certain period relative to the supply voltage.

The acts of S21 disabling the load in the compensator for a period relative to the supply voltage comprises acts of S211 synchronizing a first clock signal to the frequency of the supply voltage; S212 multiplies the first clock signal to a second clock signal whose frequency is higher than the supply voltage frequency and is phase locked to the supply voltage waveform; S213 selects a proper period from the second clock signal to turn off the load in the compensator. The period may correspond to a range that makes an overall supply current more proportional to the supply voltage, or correspond to a range that covers the supply voltage peak.

Figure 3:
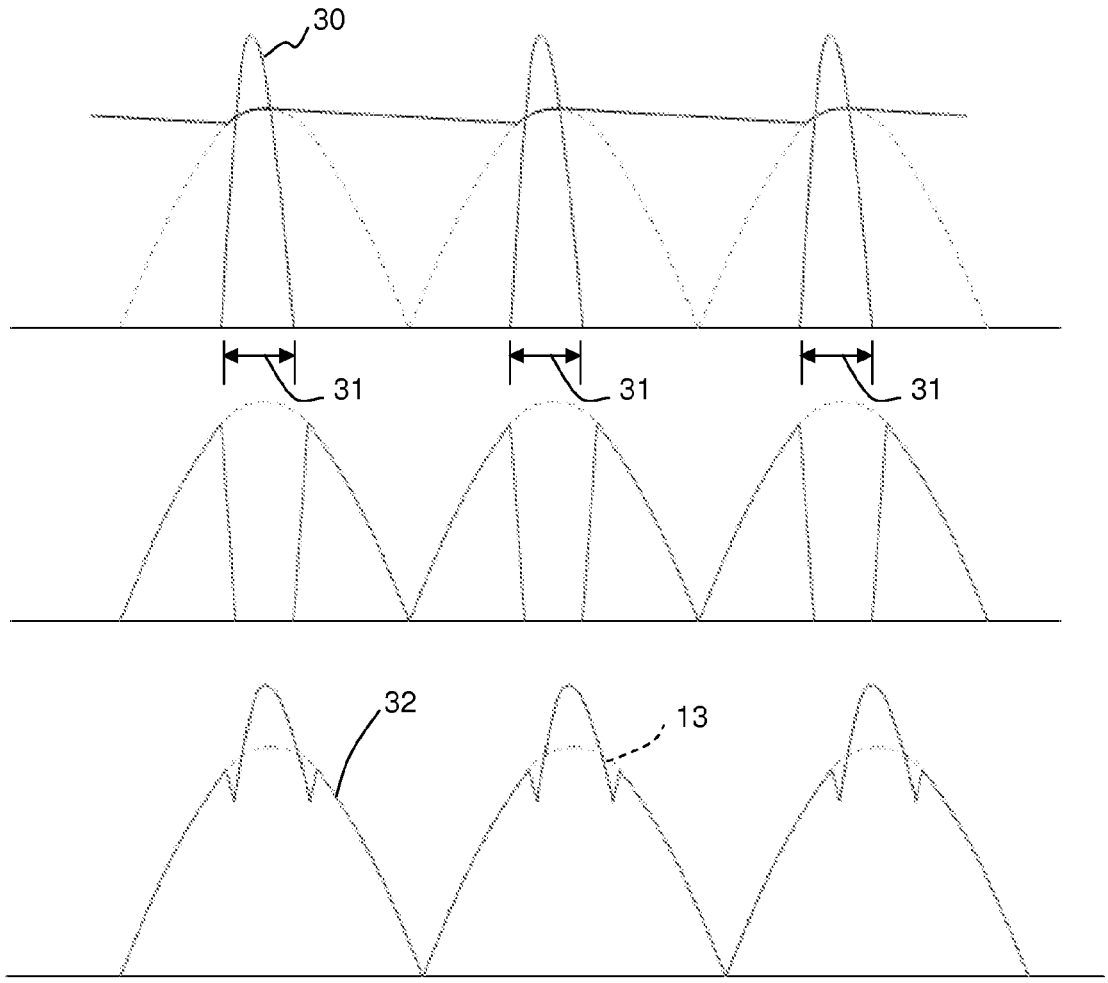
FIG. 3 is an exemplary waveform diagram of supply current and supply voltage for FIG. 2.
Figure 4:
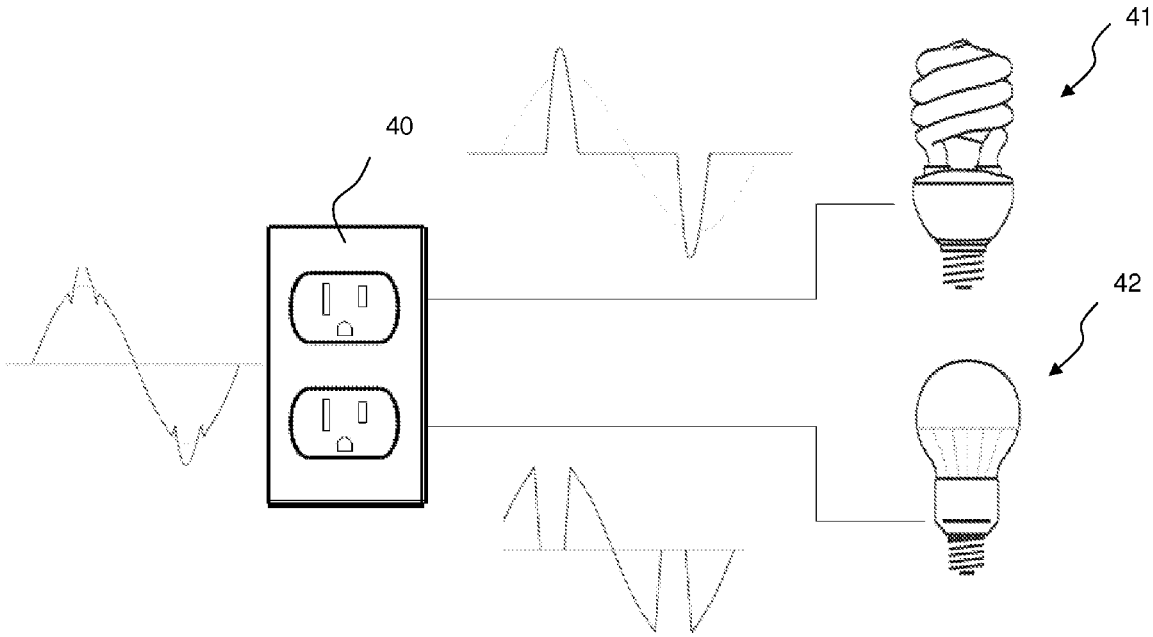
FIG. 4 is an exemplary illustration showing how the compensator and the electronic devices are utilized according to an embodiment.

With further reference to FIGS. 3 and 4, FIG. 3 is an exemplary waveform diagram of supply current and supply voltage for FIG. 2. FIG. 4 is an exemplary illustration that shows how the compensator and the electronic devices are utilized. The traditional electronic device is usually, but not limited to, a lamp that contains current spikes inherent in a non-linear load (typically a bridge rectifier load). In this example, the compensator 42 synchronizes the off periods 31 of the electronic device 41 (i.e., a traditional lamp) with the current spikes 30 inherent in a typical bridge rectifier load. The load in compensator 42 may also be a lighting component (for example, another lamp, such as integral Light Emitting Diode (LED) lamp). The common power source 40 may be a wall outlet (i.e. electrical jack).

Figure 5:
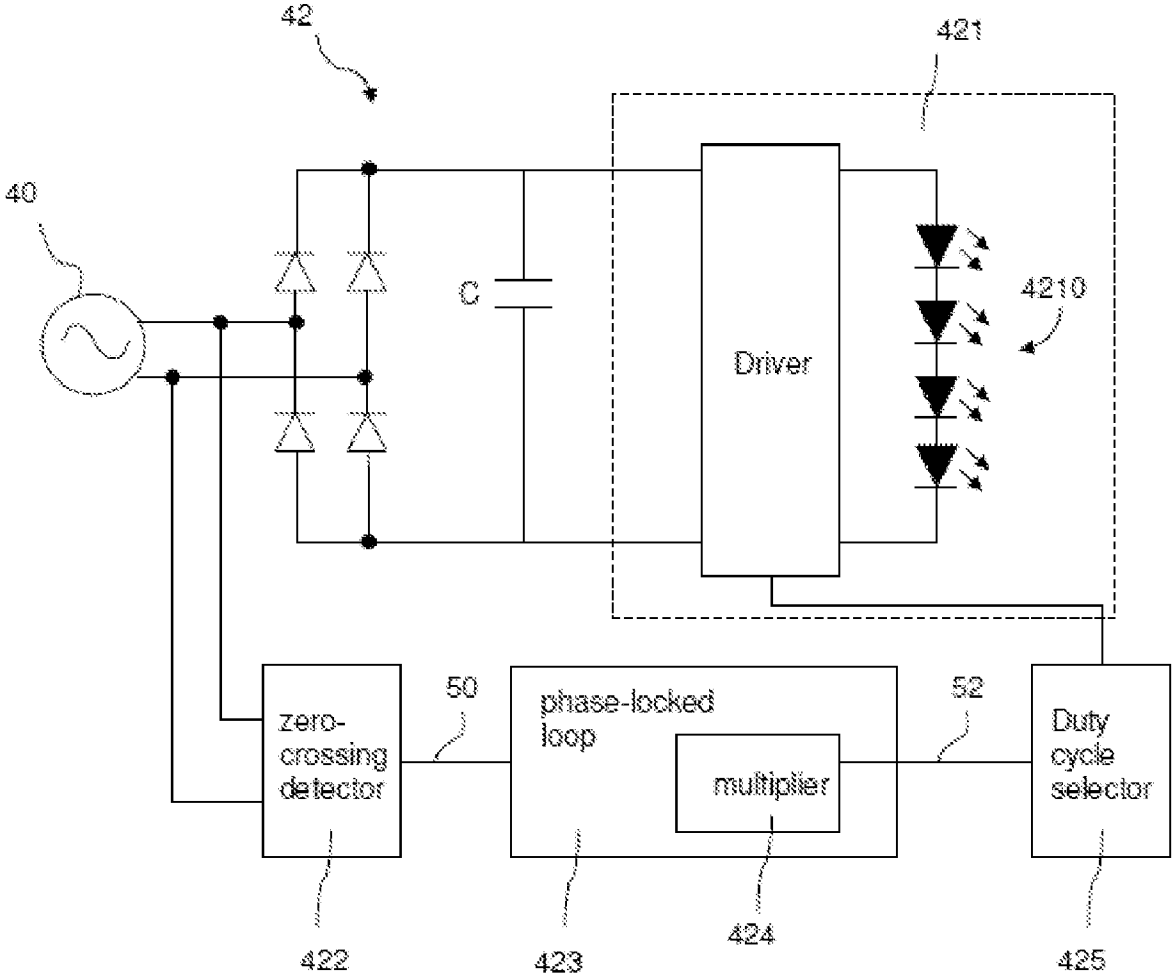
FIG. 5 is an circuit diagram of a compensator of FIG. 4 according to an embodiment of the present invention.

In this embodiment, as shown in FIGS. 4 and 5 the compensator 42 uses a phase-locked loop (PLL) 423 circuit to synchronize the first clock signal 50 to the supply voltage (usually 50 Hz or 60 Hz; for example, the line voltage in Japan may be 50 Hz or 60 Hz), and uses a zero crossing technique through a zero-crossing detector 422 to sense zero-crossing points of the supply voltage as a reference. The compensator 42 further uses a frequency multiplication technique through a multiplier 424 to provide the second clock signal 52 with frequencies that are higher than the supply voltage yet are still phase locked to the supply voltage. Once the second clock signal 52 is established, it is easy to generate a control signal, for example a duty cycle selector 425, which will select the period from the second clock signal 52 to disable the load 4210 (i.e., an LED lamp 421 in the compensator 42) so that supply current in the load 4210 of the compensator is essentially zero during this time. In this embodiment, the load 4210 in the compensator 42 is turned off during times when the supply voltage nears its peak (i.e. maximum voltage). The turn off period is accurately selected by counting pulses from the second clock signal 52.

As evident from FIG. 3, a combined current waveform 32 is plotted with the pulsating DC voltage waveform 13 of the supply voltage which may available from the bridge rectifier. Further, the current waveform is generally proportional to the voltage waveform of the supply voltage from the perspective of a power company.

In a similar manner, the proper timing for the control signal can be established by comparing the supply voltage waveform with a predetermined voltage. However, in this situation the exact timing of the control signal will change as the power supply voltage varies over normal ranges, and errors may occur.

Since a large amount of the world's electrical power is used for lighting, there is a huge opportunity to improve the power factor of electrical grids around the world by creating lighting devices that actually compensate for the poorer power factor caused by other electrical devices. In this way fewer power stations would need to be built, with a subsequent reduction in greenhouse gases as well as saving large capital investment for other projects.

In addition to the improvement of the overall power factor of a number of electronic devices on a grid which uses this embodiment in accordance with the present invention, there is also another benefit. The power compensator can, by self modulating its supply current waveform to comply more fully with the supply voltage waveform, have a native PF of 0.5 to 0.7 without using additional circuitry for a power factor correction stage. This results in a compensator which doubles as a useful lamp that can meet more stringent power factor requirements while maintaining high efficiency and lower cost.

The compensator as applied to the method of present embodiment, during the period in which it is drawing significant load current, tailors its load current to follow the input voltage waveform during that period in order to provide a reasonable power factor even when the compensator is used as a stand alone device. The compensator can slowly turn on and off its load current so that the current waveform better mimics the smooth sinusoid of the voltage waveform during the times when the load of the compensator is on.

Figure 6:
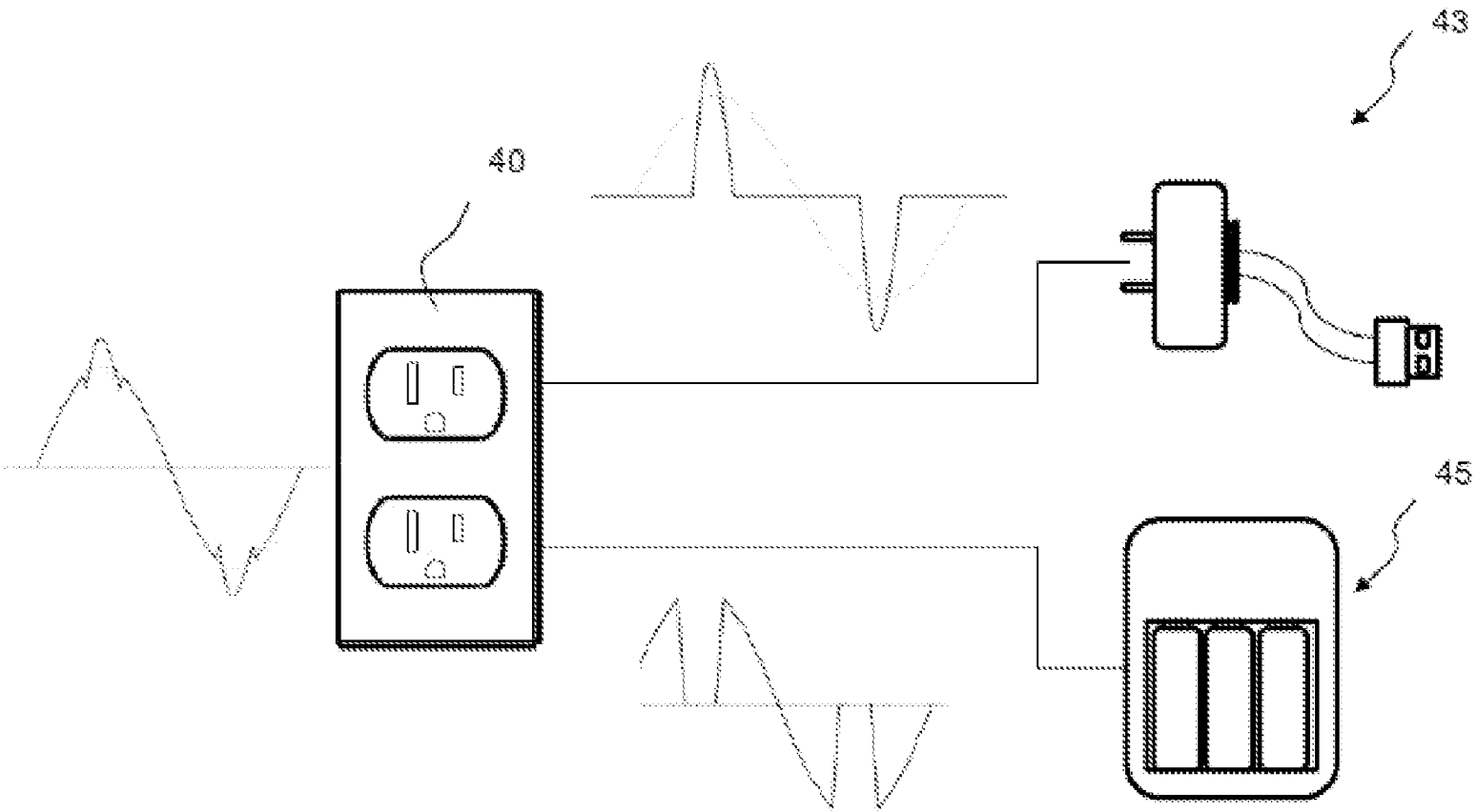
FIG. 6 is an exemplary illustration showing how the compensator and the electronic devices with a standby load are utilized according to an embodiment.
Figure 7:
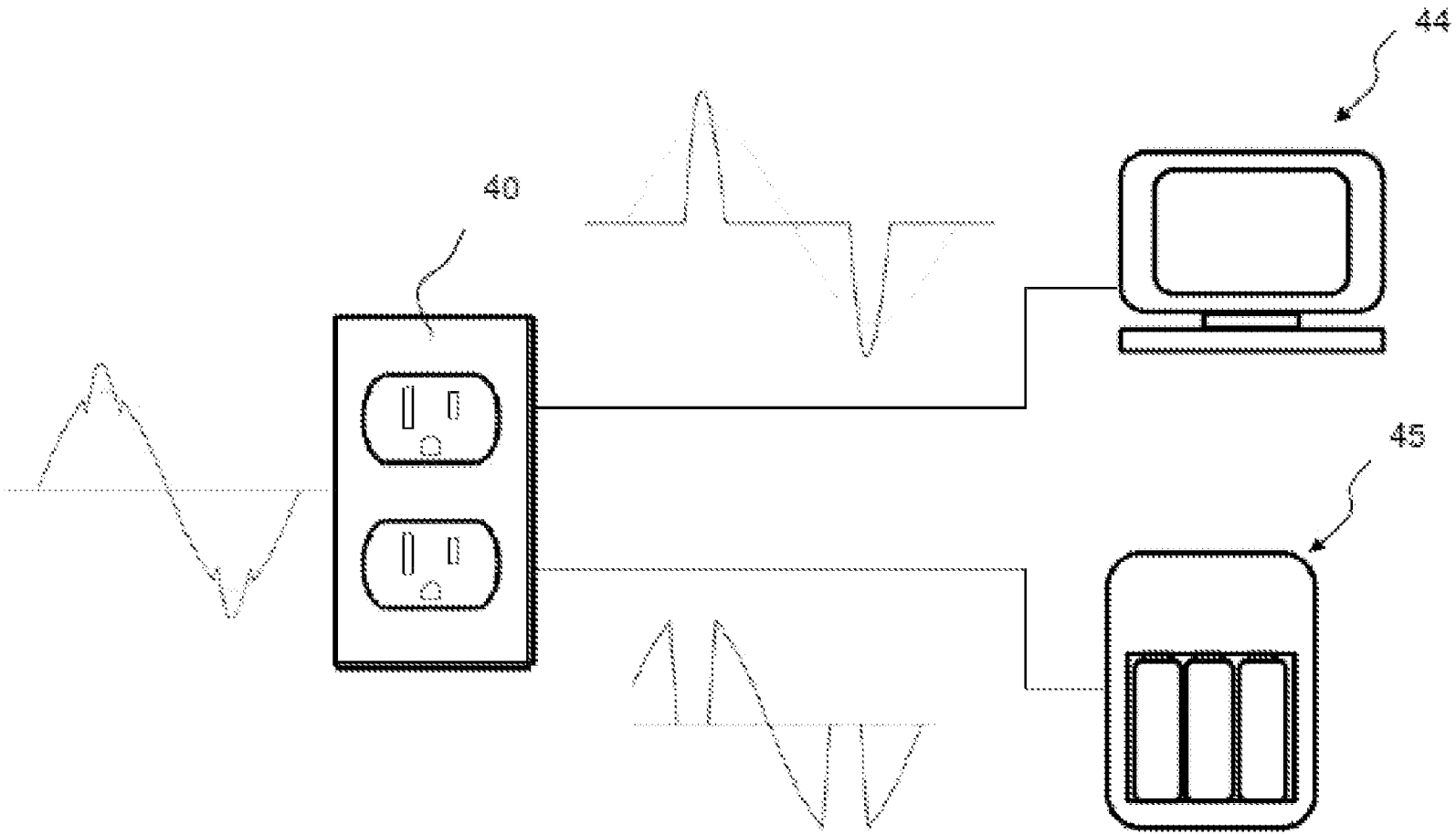
FIG. 7 is an exemplary illustration showing how the compensator and the electronic devices with a standby load are utilized according to an embodiment.

It was noted in previous examples that the load with poorer power factor was realized with a lamp. Lamps are likely not the only loads that exhibit this type of non-linear current spike. Other poor power factor non-linear loads, as shown in FIGS. 6 and 7 that are prevalent today are standby loads 43, 44 such as small mobile phone adaptors 43, LCD monitors 44 as well as the load presented by electronic devices while in their standby modes. In standby mode, although the total power drain of the load is low, the current spike seen during the peak of the supply voltage may be extremely sharp. When talking about only one or two of these types of loads then their effect on power factor would be quite small. However, there may be thousands of these types of standby loads in an office building, and their cumulative effect on power factor is quite deleterious. The embodiment described in this disclosure, perhaps a battery charger 45 to the load of the compensator, would also compensate nicely for these poor power factor standby mode loads 43, 44.

While the exemplary embodiments have been described in connection with a number of embodiments and implementations, the exemplary embodiments are not so limited but cover various obvious modifications and equivalent arrangements which fall within the purview of the appended claims. Although features of the exemplary embodiments are expressed in certain combinations among the claims, it is contemplated that these features can be arranged in any combination and order.

What is claimed is:

1. A power factor compensating method compensating a power factor of a traditional electronic device connected to a power source and the electronic device being a type of a non-linear load, and the power factor compensating method comprising enabling a compensator to receive a supply voltage from the power supply source that being commonly connected to the electronic device;

generating a first clock signal synchronized to the supply voltage;

generating a second clock signal based on the first clock signal;

selecting a period from the second clock signal; and disabling a load of the compensator for the period, wherein the period corresponds to a range near a peak of a waveform of the supply voltage.

2. The method as claimed in claim 1, wherein the acts of generating a second clock signal based on the first clock signal comprises acts of multiplying the first clock signal to the second clock signal whose frequency is higher than a frequency of the supply voltage and is phase locked to the waveform of the supply voltage.

3. The method as claimed in claim 2, wherein the compensator uses a phase-locked loop circuit to synchronize the first clock signal to the supply voltage, and uses a zero crossing technique to sense zero-crossing points of the waveform of the supply voltage as a reference.

4. The method as claimed in claim 2, wherein the compensator uses a frequency multiplication technique to provide the second clock signal with frequencies that are higher than the supply voltage yet still phase locked to the supply voltage.

5. The method as claimed in claim 2, wherein the compensator uses a duty cycle selector to select the period from the second clock signal.

6. The method as claimed in claim 1, wherein the traditional non-linear load is a lamp.

7. The method as claimed in claim 1, wherein the traditional non-linear load is a standby mode load in the electronic device.

8. The method as claimed in claim 1, wherein the load of the compensator is a lamp.

9. The method as claimed in claim 1, wherein the load of the compensator is a battery charger.

10. The method as claimed in claim 1, wherein the compensator, during the period in which it is drawing significant load current, tailors its load current to follow the input voltage waveform during that period in order to provide a reasonable power factor even when the compensator is used as a stand alone device.

* * * * *